US006776675B2

(12) United States Patent
Fuse

(10) Patent No.: US 6,776,675 B2
(45) Date of Patent: Aug. 17, 2004

(54) JET PROPULSION BOAT

(75) Inventor: Tomohiro Fuse, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/216,866

(22) Filed: Aug. 13, 2002

(65) Prior Publication Data

US 2003/0068933 A1 Apr. 10, 2003

(30) Foreign Application Priority Data

Sep. 18, 2001 (JP) ..... 2001-283784

(51) Int. Cl.[7] ..... B63H 11/113
(52) U.S. Cl. ..... 440/42; 440/47
(58) Field of Search ..... 440/38–43, 47, 440/66, 67; 60/221, 222

(56) References Cited

U.S. PATENT DOCUMENTS 3,143,857 A * 8/1964 Eaton ..... 60/221
3,939,794 A * 2/1976 Hull ..... 440/38
5,045,003 A * 9/1991 Ikeda ..... 440/42
5,395,272 A * 3/1995 Smith ..... 440/42
5,551,898 A * 9/1996 Matsumoto ..... 440/41
5,649,843 A * 7/1997 Elger ..... 440/38
6,102,756 A * 8/2000 Michel et al. ..... 440/42
6,558,211 B2 * 5/2003 Freitag et al. ..... 440/42

FOREIGN PATENT DOCUMENTS

JP 2-254094 10/1990
JP 0913195 A * 5/1997 ..... B63H/11/10

* cited by examiner

*Primary Examiner*—S. Joseph Morano
*Assistant Examiner*—Ajay Vasudeva
(74) *Attorney, Agent, or Firm*—Birch, Stewart, Kolasch & Birch, LLP

(57) ABSTRACT

To provide a jet propulsion boat which can be efficiently propelled by disposing a steering nozzle closer to the bottom of the boat. A jet propulsion boat includes a jet propulsion apparatus driven by an engine at the stern. A jet nozzle for jetting water is provided at the rear portion of the jet propulsion apparatus. A steering nozzle is swingably supported by the jet nozzle so as to adjust the direction of a stream of water jetted from the jet nozzle. In the jet propulsion boat, an outlet side of the jet nozzle is covered with an inlet side of the steering nozzle and the vertical diameter D2 of the inlet of the steering nozzle is set to be smaller than the transverse diameter D1 of the inlet.

14 Claims, 9 Drawing Sheets

JET PROPULSION BOAT

CROSS-REFERENCE TO RELATED APPLICATIONS

The present application claims priority under 35 USC 119 to Japanese Patent Application No. 2001-283784 filed on Sep. 18, 2001 the entire contents thereof is hereby incorporated by reference.

BACKGROUND OF THE INVENTION

1. Field of the Invention

The present invention relates to a jet propulsion boat having a jet propulsion apparatus at the stern, a jet nozzle for jetting water, which is provided in the rear portion of the jet propulsion apparatus, and a steering nozzle swingably supported by the jet nozzle to adjust the direction of a stream of water jetted from the jet nozzle.

2. Description of Background Art

A jet propulsion boat is disclosed in Japanese Unexamined Patent Application No. Hei-2-254094, entitled "Forward/Rearward Travel Switching Apparatus of Water Jet Boat Propulsion Apparatus." FIG. 10 is a copy of FIG. 1 of this publication with the reference numerals added to designate the parts thereof. This type of jet propulsion boat will be described in detail with reference to FIG. 10.

FIG. 10 is a cross section of a conventional jet propulsion boat. A jet propulsion boat 100 has a jet propulsion apparatus 102 at the stern 101. A jet nozzle 103 is provided at the rear portion of the jet propulsion apparatus 102 with an outlet 103*a* side of the jet nozzle 103 being covered with an inlet 104*a* side of a steering nozzle 104. The inlet 104*a* side of the steering nozzle 104 and the outlet 103*a* side of the jet nozzle 103 are swingably coupled to each other by upper and lower supporting bolts 105 and 105.

The jet propulsion boat 100 can be propelled by driving an impeller 102*a* of the jet propulsion apparatus 102 to thereby take water from an intake port 106, jetting the water from the jet nozzle 103, and jetting the jetted water from an outlet 104*b* of the steering nozzle 104.

At the time of propulsion of the jet propulsion boat 100, by swinging the steering nozzle 104 from side to side by using the upper and lower supporting bolts 105 and 105 as a center, the jet propulsion boat 100 can be turned from side to side.

In the jet propulsion boat 100, when the steering nozzle 104 is swung from side to side by using the upper and lower supporting bolts 105 and 105 as a center, it is necessary to prevent that the inner circumference on the inlet 104*a* side of the steering nozzle 104 interferes with the outer circumference on the outlet 103*a* side of the jet nozzle 103.

Consequently, the inner circumference on the inlet 104*a* side of the steering nozzle 104 has to be set apart from the outer circumference on the outlet 103*a* side of the jet nozzle 103 by some distance.

The outer circumference on the inlet 104*a* side of the steering nozzle 104 therefore becomes relatively large, and it disturbs the steering nozzle 104 that is disposed close to the boat bottom 101.

When the steering nozzle 104 is positioned apart from the boat bottom 101, the impeller 102*a* of the jet propulsion apparatus 102 is provided in a high position. Consequently, the curvature of the intake path from the intake port 106 to the impeller 102*a* increases, so that it becomes difficult to smoothly introduce the taken water to the impeller 102*a* side. For example, a cavitation occurs in the jet propulsion apparatus 102 and it hinders the jet propulsion boat 100 from being efficiently propelled.

SUMMARY AND OBJECTS OF THE INVENTION

An object of the invention is therefore to provide a jet propulsion boat which can be efficiently propelled by disposing a steering nozzle closer to the bottom of the boat.

To achieve the object, the present invention provides a jet propulsion boat including a jet propulsion apparatus driven by an engine at the stern, a jet nozzle for jetting water, which is provided in the rear portion of the jet propulsion apparatus, and a steering nozzle swingably supported by the jet nozzle so as to adjust the direction of a stream of water jetted from the jet nozzle, and the jet propulsion boat includes an outlet of the jet nozzle that is covered with an inlet of the steering nozzle, and the vertical diameter of the inlet of the steering nozzle is set to be smaller than the transverse diameter of the inlet.

By setting the vertical diameter of the inlet of the steering nozzle to be smaller than the transverse diameter, the steering nozzle can be disposed closer to the boat bottom. The jet propulsion apparatus can be accordingly disposed closer to the boat bottom with the curvature of the intake path extending from the intake port to the jet propulsion apparatus that can be flattened and with the intake path being formed in a gentle curve.

Consequently, water taken from the intake port can be smoothly directed to the jet propulsion apparatus, so that, for example, the occurrence of a cavitation can be prevented and water can be jetted efficiently.

In addition, by setting the vertical diameter to be smaller than the transverse diameter, the transverse diameter can be assured to be large. Consequently, the steering angle of the steering nozzle can be assured to a specified amount and the steering performance of the jet propulsion boat can be assured sufficiently.

To favorably propel the jet propulsion boat, the nozzle for jetting water has preferably a circular shape. In the present invention, therefore, the outlet of the jet nozzle is covered with the inlet of the steering nozzle.

With the configuration, even when the vertical diameter of the inlet of the steering nozzle is smaller than the transverse diameter, this portion can be disconnected from the water stream. Therefore, exertion of an adverse influence onto the stream of water in the nozzle can be prevented.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Embodiments of the invention will be described hereinbelow with reference to the attached drawings.

Figure 1:
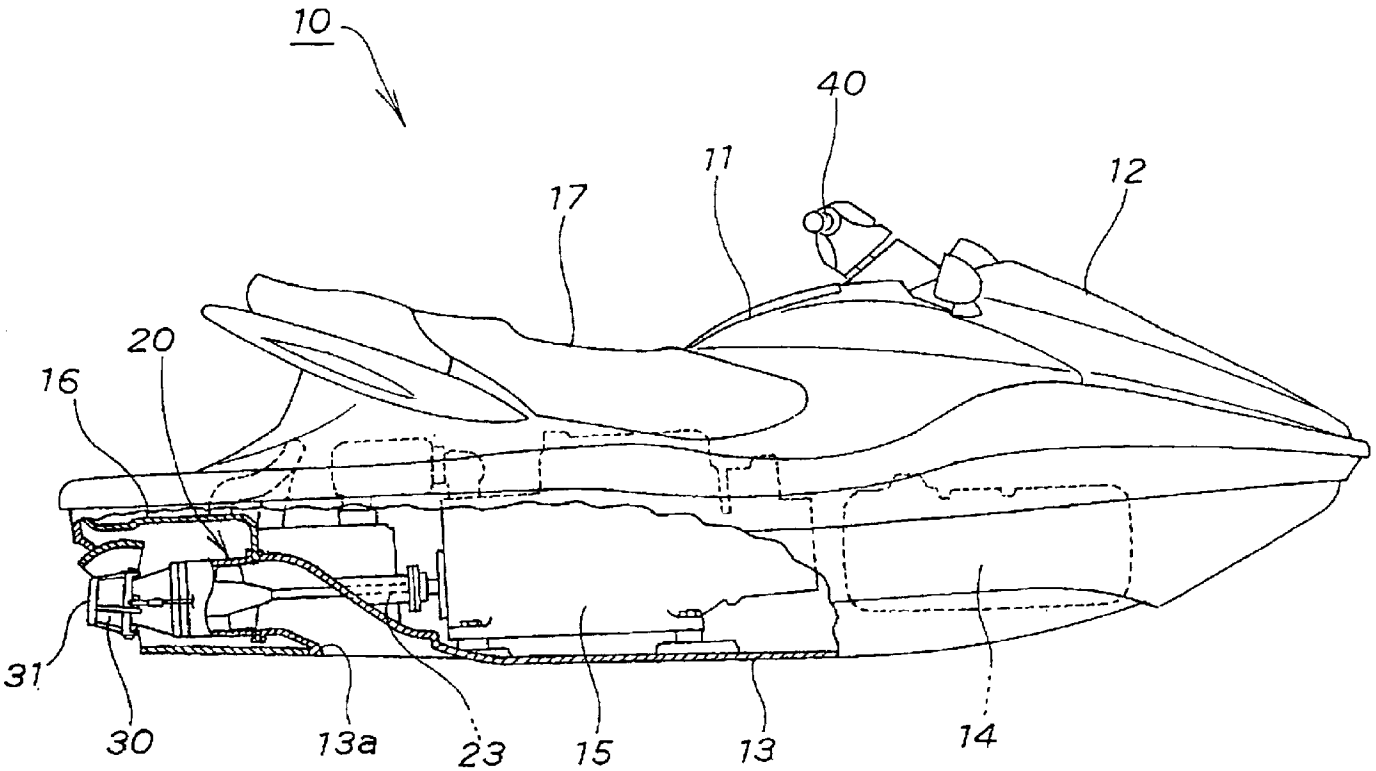
FIG. 1 is a side view of a jet propulsion boat according to a first embodiment of the present invention.

FIG. 1 is a side view of a jet propulsion boat (first embodiment) according to the present invention.

A jet propulsion boat 10 has a fuel tank 14 attached in a front part 12 of a boat body 11 with an engine 15 on the rear side of the fuel tank 14. A jet propulsion apparatus chamber 16 is disposed on the rear side of the engine 15 with a jet propulsion apparatus 20 in the jet propulsion apparatus housing 16 at the stern. A steering nozzle 30 is provided on the rear side of the jet propulsion apparatus 20 with a steering handle 40 for operating the steering nozzle 30 being attached above the fuel tank 1. A seat 17 is provided on the rear side of the steering handle 40.

Figure 2:
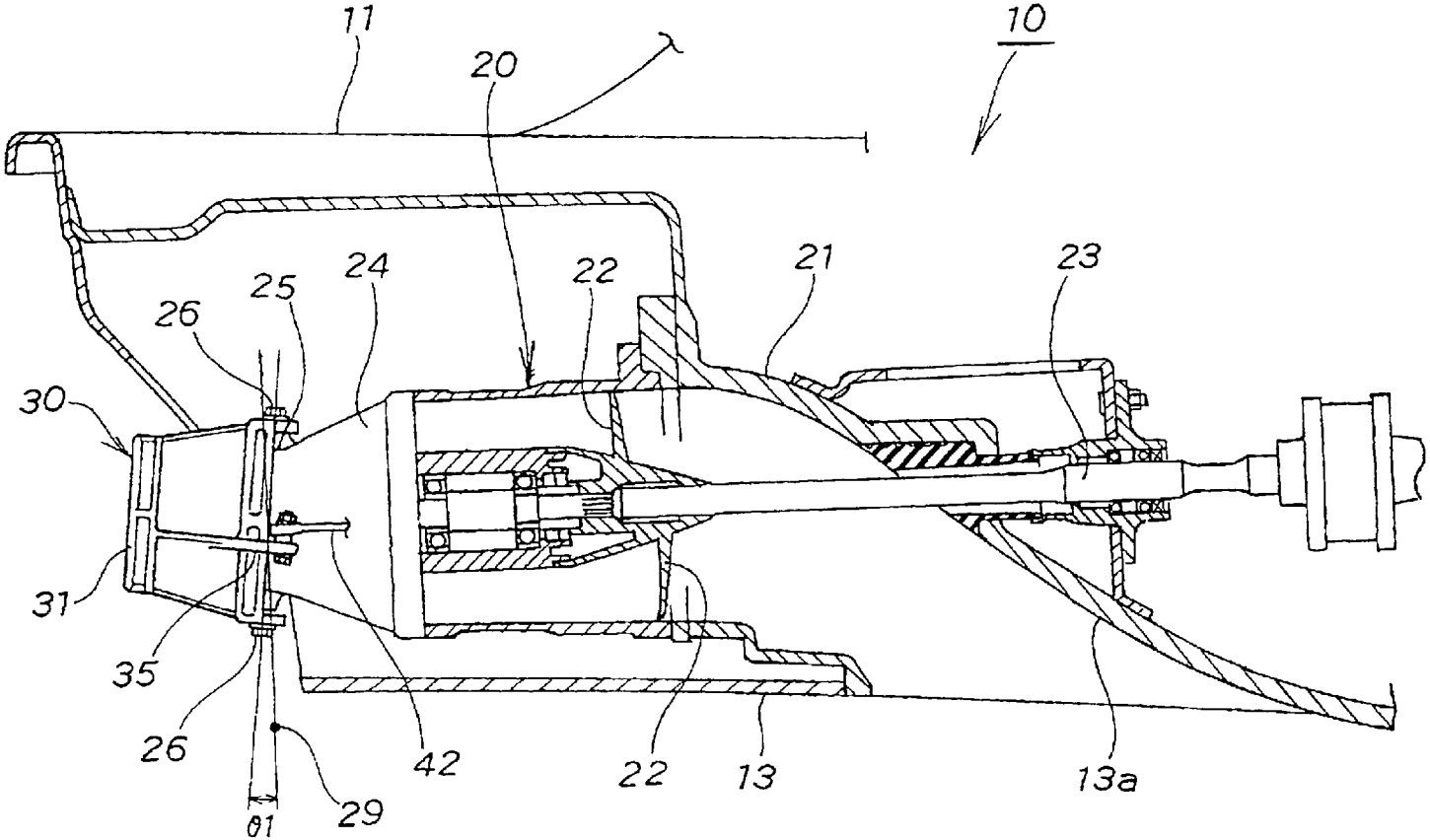
FIG. 2 is an enlarged view of a main portion of the jet propulsion boat according to a first embodiment of the present invention.

FIG. 2 is an enlarged diagram of the main portion of the jet propulsion boat according to the first embodiment of the present invention.

The jet propulsion apparatus 20 has a housing 21 extending from an intake port 13*a* on the boat bottom 13 to the rear. An impeller 22 is rotatably attached in the housing 21 and is coupled to a drive shaft 23 of the engine 15 (shown in FIG. 1).

The steering nozzle 30 is a member attached to the rear end of the housing 21 (that is, an outlet 25 of a jet nozzle 24) so as to be swingable from side to side. An operational cable 42 is coupled to the steering nozzle 30 via an arm 35 and is coupled to the steering handle 40 (shown in FIG. 1), so that the steering nozzle 30 can swing from side to side by using the upper and lower supporting bolts 26 and 26 as a center by operating the operational cable 42 by the steering handle 40.

In the jet propulsion boat 10 constructed as described above, fuel is supplied from the fuel tank 14 shown in FIG. 1 to the engine 15 to drive the engine 15. The driving force of the engine 15 is transmitted to the impeller 22 via the drive shaft 23 to rotate the impeller 22, thereby taking water from the intake port 13*a* of the boat bottom 13. The water is jetted as jet water from the rear end of the housing 21, specifically, from an outlet 31 of the steering nozzle 30 via an outlet 25 of the joint nozzle 24.

At this time, the operational cable 42 is operated by the steering handle 40 (refer to FIG. 1) to swing the steering nozzle 30 from side to side by using upper and lower supporting bolts 26 and 26 as a center, thereby enabling the boat body 11 to be turned to the right or left.

In the jet propulsion apparatus 10, to maintain the propelled posture of the boat body 11 preferably, the steering nozzle 30 is disposed so as to be inclined upwardly to the rear with respect to the axis of the jet nozzle 24. To dispose the steering nozzle 30 to be inclined upwardly to the rear, the upper and lower supporting bolts 26 and 26 are inclined from a vertical line 29 only by an inclination angle θ1.

Figure 3:
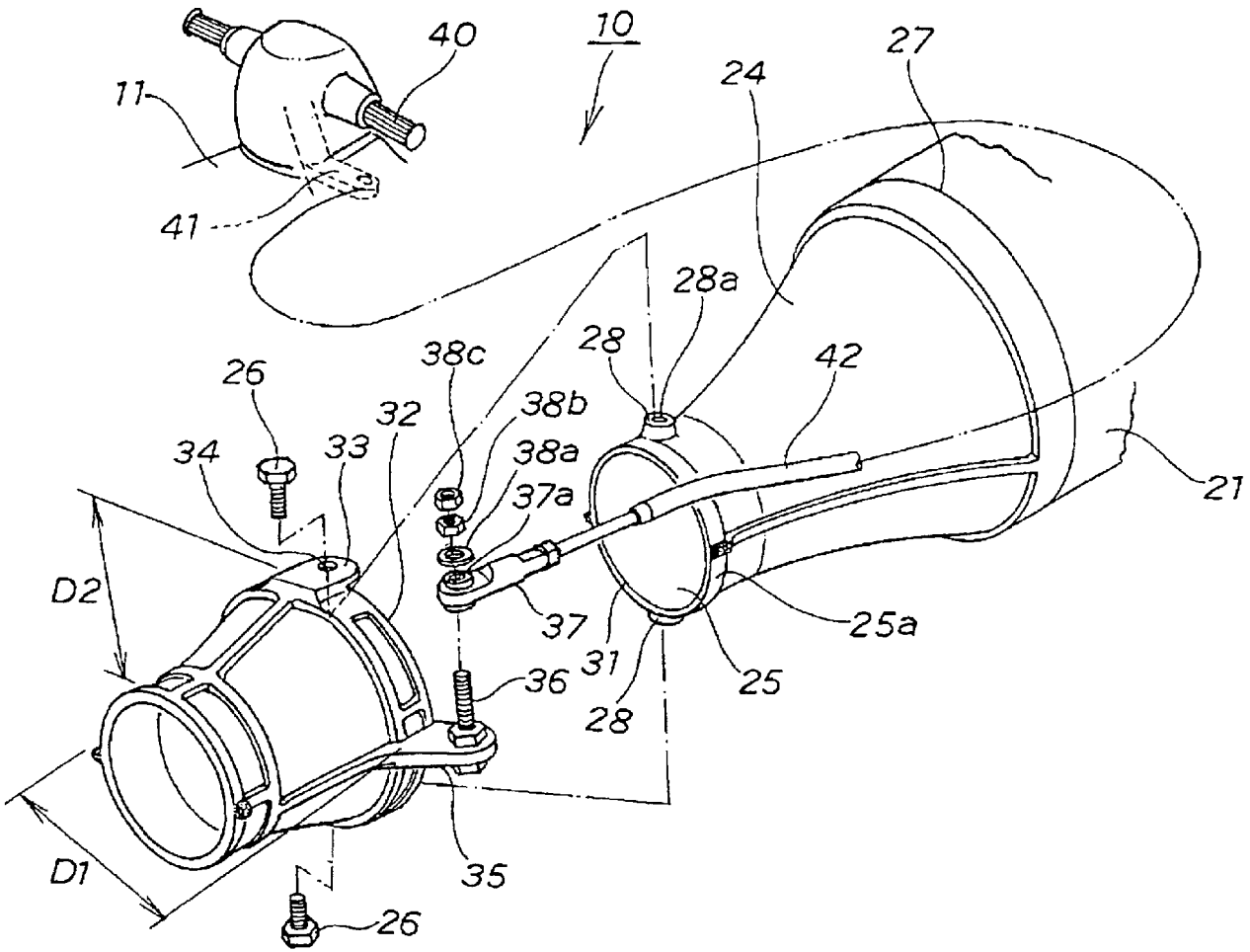
FIG. 3 is an exploded perspective view showing the main portion of the jet propulsion boat according to a first embodiment of the present invention.

FIG. 3 is an exploded perspective view showing the main portion of the jet propulsion boat according to a first embodiment of the present invention.

The jet nozzle 24 is a cylindrical body having a circular truncated cone shape formed so that its diameter is gradually reduced toward the rear and is a member constructing the rear end portion of the housing 21. The jet nozzle 24 has upper and lower bosses 28 and 28 on the outer circumference 25*a* of the outlet 25. In the upper and lower bosses 28 and 28, female screw threads 28*a* and 28*a* (only the upper one is shown) are formed for attachment with the upper and lower supporting bolts 26 and 26.

The steering nozzle 30 is a cylindrical body having a circular truncated cone shape formed so that its diameter is gradually reduced toward the rear in a manner similar to the jet nozzle 24. Flat portions 33 and 33 (only the upper one is shown) are formed on the upper and lower portions on an inlet 32 side. Attachment holes 34 and 34 are formed in the upper and lower flat portions 33 and 33, and an arm 35 is provided on the right-side wall on the inlet 32 side.

To attach the jet nozzle 24 to the steering nozzle 30, the outlet 25 side of the jet nozzle 24 is covered with the inlet 32 side of the steering nozzle 30 and the upper and lower supporting bolts 26 and 26 are inserted into the attachment holes 34 and 34 of the upper and lower flat portions 33 and 33, respectively. Thereafter, the inserted supporting bolts 26 and 26 are screwed in the upper and lower female screws 28*a* and 28*a* of the jet nozzle 24. In such a manner, the steering nozzle 30 can be attached so as to be swingable from side to side.

On the other hand, an attachment rod 36 is attached to the front end of the arm 35 and inserted into a through hole 37*a* of a joint 37 and a washer 38*a*, and a nut 38*b* and a lock nut 38*c* are sequentially screwed together, thereby enabling the operational cable 42 to be coupled to the arm 35.

The steering nozzle 30 is formed so that a vertical diameter D2 of a diameter of the inlet 32 (inlet diameter) of the steering nozzle 30 is to be smaller than a transverse diameter D1.

By coupling the operational cable 42 to the arm 41 of the steering handle 40, the steering nozzle 30 can be swung from side to side by the operation of the operational cable 42 with the steering handle 40.

Figure 4:
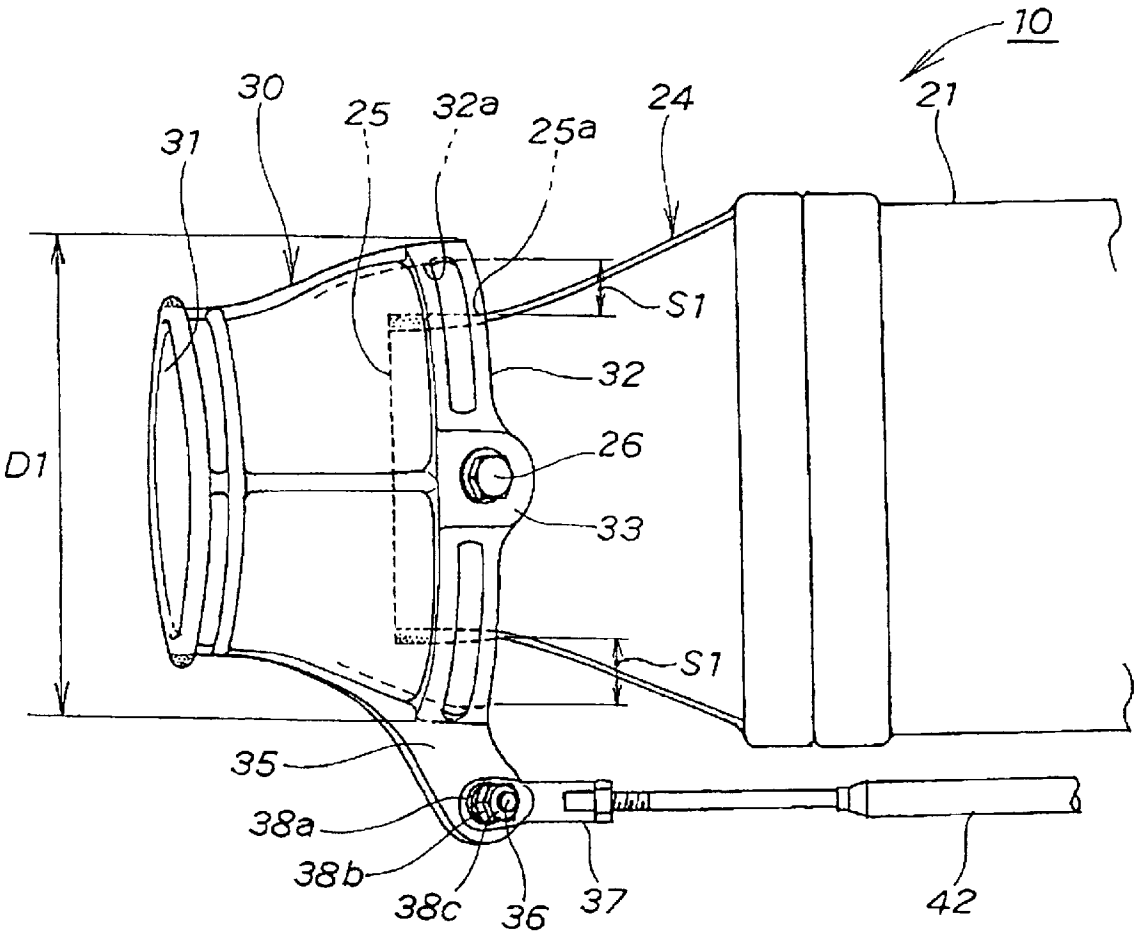
FIG. 4 is a plan view showing the main portion of the jet propulsion boat according to a first embodiment of the present invention.

FIG. 4 is a plan view showing the main portion of the jet propulsion boat (first embodiment) according to the invention.

By setting the diameter of the inlet 32 (inlet diameter) of the steering nozzle 30 so that the vertical diameter D2 (shown in FIG. 3) is smaller than the transverse diameter D1, while suppressing the vertical diameter D2, the transverse diameter D1 can be set to be large. Thus, right and left spacings S1 and S1 each between the outer circumference 25*a* on the outlet 25 side of the jet nozzle 24 and the inner circumference 32*a* on the inlet 32 side of the steering nozzle 30 can be relatively largely assured.

Consequently, at the time of swinging the steering nozzle 30 from side to side by the operational cable 42 by using the upper and lower supporting bolts 26 and 26 as a center, a large inclination angle of the steering nozzle 30 can be assured.

In addition, the outlet 25 side of the jet nozzle 24 is covered with the inlet 32 side of the steering nozzle 30. With the arrangement, even when the diameter on the inlet 32 side of the steering nozzle 30 is set so that the vertical diameter D2 is smaller than the transverse diameter D1, the inlet 32 side can be disconnected from the water stream on the outlet 25 side of the jet nozzle 24.

Therefore, an adverse influence is prevented from being exerted on the water stream in the nozzle, and the jet propulsion boat 10 can be favorably propelled.

Figure 5A:
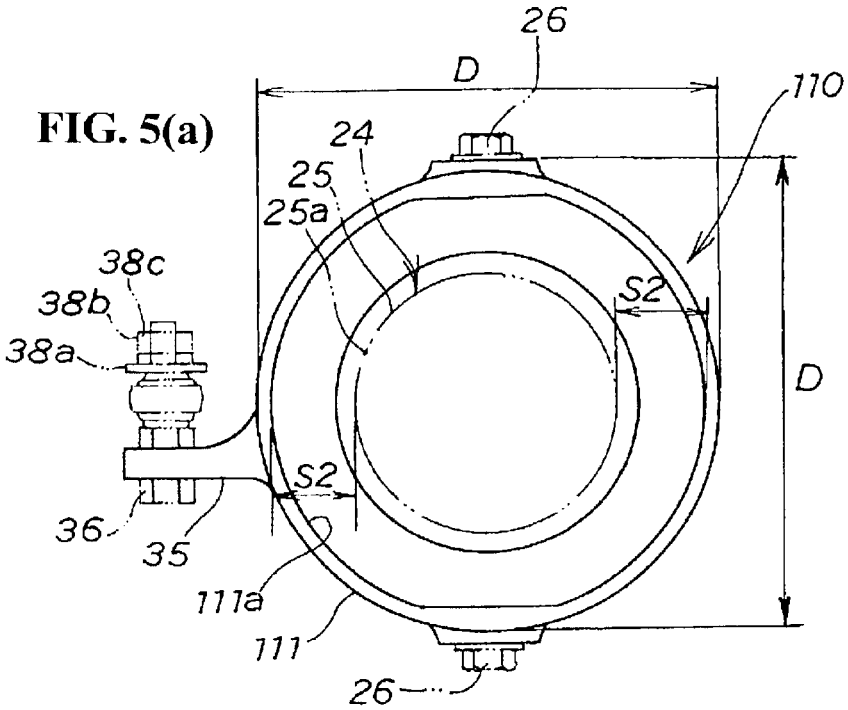
FIGS. 5(*a*) and 5(*b*) are front views for explaining the shape of the inlet of a steering nozzle as a component of the jet propulsion boat according to a first embodiment of the present invention.
Figure 5B:
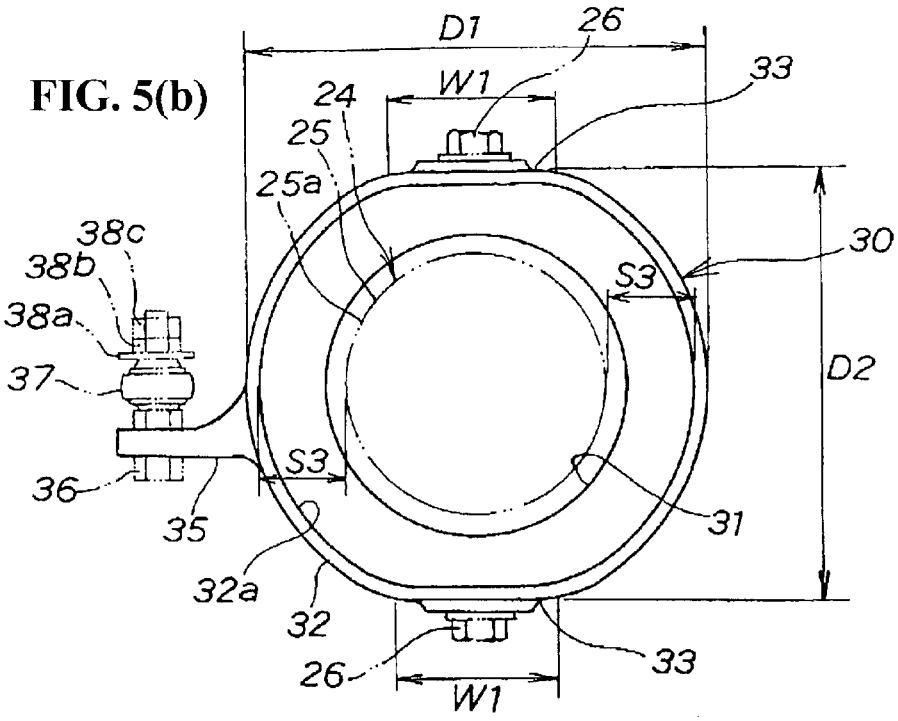

FIGS. 5(*a*) and 5(*b*) are front views for explaining the shape of the inlet of the steering nozzle as a component of the jet propulsion boat (first embodiment) according to the present invention. FIG. 5(*a*) shows a comparative example and FIG. 5(*b*) explains the embodiment as an example.

In FIG. 5(*a*), by forming an inlet 111 of a steering nozzle 110 in a circular shape, a spacing S2 between the inner circumference 111*a* of the inlet 111 of the steering nozzle 110 and the outer circumference 25*a* of the outlet 25 of the jet nozzle 24 can be assured to be large to a certain extent, and the steering angle of the steering nozzle 110 can be assured in a specified amount.

However, by forming the inlet 111 of the steering nozzle 110 in a circular shape, the height on the inlet 111 side of the steering nozzle 110 becomes the same as the diameter D of the inlet 111 and is large. Consequently, the steering nozzle 110 is apart from the bottom of the boat, and the jet propulsion apparatus is accordingly apart from the bottom of the boat. Thus, the curvature of the intake path extending from the intake port to the jet propulsion apparatus becomes large, and the intake path cannot be formed in a gentle curve.

It becomes difficult to smoothly lead water sucked from the intake port to the impeller side of the jet propulsion apparatus. For example, a cavitation occurs in the jet propulsion apparatus and it hinders the jet propulsion apparatus from being efficiently propelled.

Although it can be also considered to reduce the diameter on the inlet 111 side of the steering nozzle 110 to dispose the steering nozzle 110 close to the boat bottom, when the diameter of the inlet 111 of the steering nozzle 110 is set to be small, the spacing S2 between the inner circumference of the inlet 111 of the steering nozzle 110 and the outer circumference 25*a* of the outlet 25 of the jet nozzle 24 is narrowed.

Therefore, the inclination angle of the steering nozzle 110 cannot be sufficiently assured. Before the steering nozzle 110 is inclined by a predetermined angle, the inner circumference of the inlet 111 of the steering nozzle 110 comes into contact with the outer circumference 25*a* of the outlet 25 of the jet nozzle 24, so that a sufficient steering angle cannot be assured.

In FIG. 5(*b*), by forming the flat portions 33 and 33 each having a width W1 in the upper and lower portions of the inlet 32 of the steering nozzle 30, the vertical diameter D2 of the inlet 32 is set to be smaller than the transverse diameter D1 to suppress the height of the steering nozzle 30. Thus, the steering nozzle 30 can be disposed closer to the boat bottom 13 (shown in FIG. 2).

By disposing the steering nozzle 30 closer to the boat bottom 13, the jet propulsion apparatus 20 (shown in FIG. 2) can be disposed closer to the boat bottom 13. The curvature of the intake path (a part of the housing) extending from the intake port 13*a* to the jet propulsion apparatus 20 can be therefore decreased to form the intake path in a gentle curve.

Consequently, water taken from the intake port 13*a* can be smoothly led to the jet propulsion apparatus 20. For example, the occurrence of a cavitation can be prevented, and water can be jetted efficiently. Thus, the jet propulsion boat 10 can be efficiently propelled.

In addition, the transverse diameter D1 can be assured to be large, so that the spacing S3 between the inner circumference 32*a* of the inlet 32 of the steering nozzle 30 and the outer circumference 25*a* of the outlet 25 of the jet nozzle 24 can be assured to be large, and the steering angle of the steering nozzle 30 can be assured in a specified amount. Consequently, the steering performance of the jet propulsion boat 10 can be maintained preferably.

The action of the steering nozzle 30 of the jet propulsion boat 10 will now be described by referring to FIGS. 6(*a*) and 6(*b*).

Figure 6A:
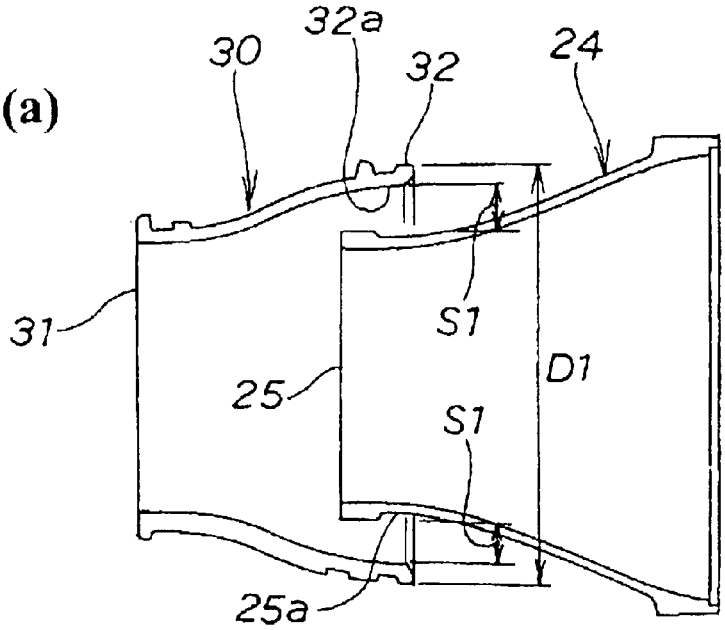
FIGS. 6(*a*) and 6(*b*) are diagrams for explaining a steering angle of the steering nozzle provided for the jet propulsion boat according to a first embodiment of the present invention.
Figure 6B:
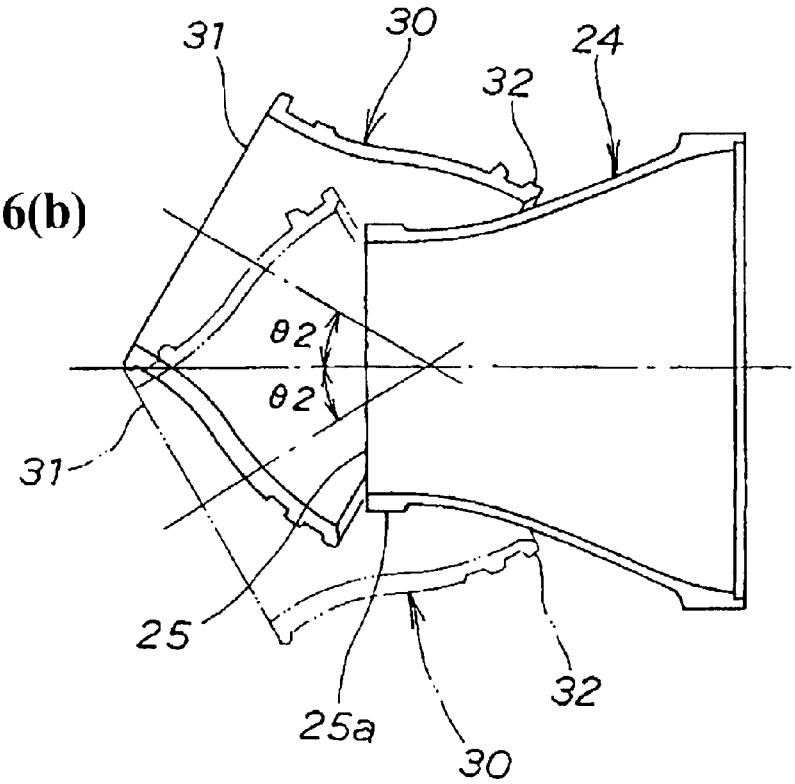

FIGS. 6(*a*) and 6(*b*) are diagrams for explaining the steering angle of the steering nozzle of the jet propulsion boat according to the first embodiment of the present invention.

As shown in FIG. 6(*a*), the vertical diameter D2 (shown in FIG. 3) of the diameter of the inlet of the steering nozzle 30 is formed to be smaller than the transverse diameter D1, the right and left spacings S1 and S1 each between the outer circumference 25*a* of the outlet 25 of the net nozzle 24 and the inner circumference 32*a* on the inlet 32 side of the steering nozzle 30 can be assured to be relatively large.

In FIG. 6(*b*), a state where the steering nozzle 30 is steered to the left is shown by solid lines, and a state where the steering nozzle 30 is steered to the right is shown by imaginary lines. The right and left steering angles θ2 and θ2 of the steering nozzle 30 can be assured to be large.

In addition, by setting the vertical diameter D2 (shown in FIG. 3) of the inlet of the steering nozzle 30 to be smaller than the transverse diameter D1 (shown in FIG. 6(*a*)), the angle of contact of the jet water stream can be changed, and the steering force can be reduced.

A mold 50 for casting the steering nozzle 30 will now be described by referring to FIGS. 7(*a*) and 7(*b*).

Referring again to FIG. 3, the cylindrical body of the jet nozzle 24 can correspond to various models without changing the shape. However, a portion of the jet nozzle 24, to which the steering nozzle 30 is attached, that is, the positions of the upper and lower bosses 28 and 28 have to be changed with every model.

For this purpose, the upper and lower bosses 28 and 28 are formed by cores. Only the cores are changed and the mold of the basic portion of the jet nozzle 24 can be commonly used. This example will be described in detail hereinbelow by referring to FIGS. 7(*a*) and 7(*b*).

Figure 7A:
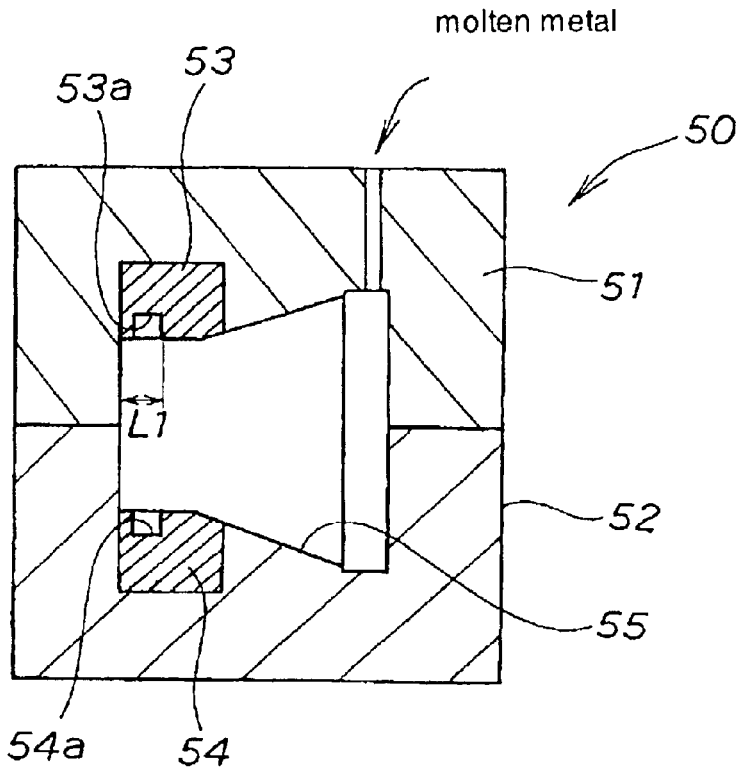
FIGS. 7(*a*) and 7(*b*) are diagrams for explaining a mold 50 of the steering nozzle 30 as a component of the jet propulsion boat according to a first embodiment of the present invention.
Figure 7B:
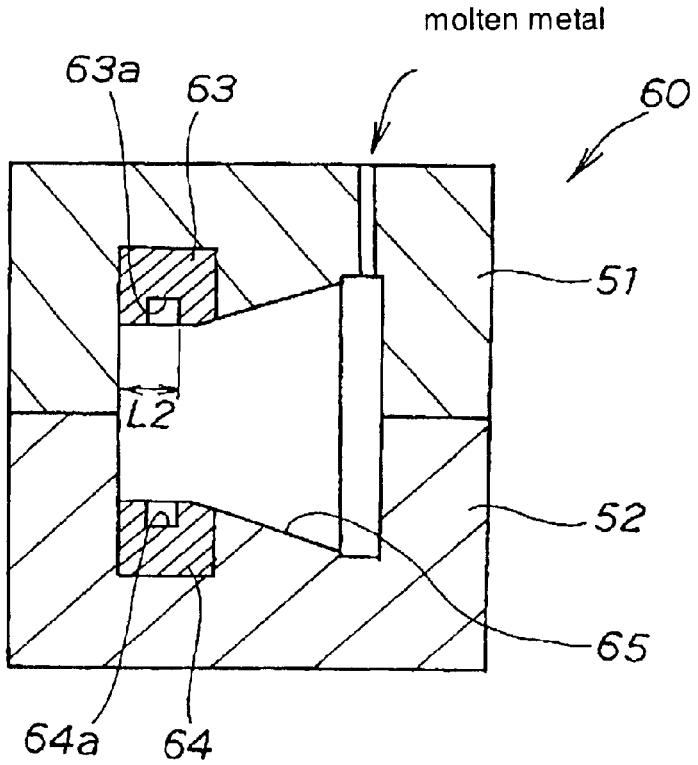

FIGS. 7(*a*) and 7(*b*) are diagrams for explaining the mold 50 of the steering nozzle 30 as a component of the jet propulsion boat (first embodiment) according to the embodiment.

In FIG. 7(*a*), upper and lower cores 53 and 54 are set to an upper mold (movable mold) 51 and a lower mold (fixed mold) 52 of the mold 50, respectively.

The upper and lower cores 53 and 54 are obtained by forming recesses 53*a* and 54*a* serving as the upper and lower bosses 28 and 28 (refer to FIG. 3), respectively, in a state near to the outlet 31 side of the steering nozzle 30 shown in FIG. 3, that is, in positions of a distance L1.

The mold 50 is clamped in this state and, after that, by filling a cavity 55 with molten metal, the cylindrical body having a circular truncated cone shape of the steering nozzle 30 is molded by the upper and lower molds 51 and 52 and cores (not shown) in the jet nozzle 24, and the upper and lower bosses 28 and 28 are formed by the upper and lower cores 53 and 54.

In such a manner, the upper and lower bosses 28 and 28 can be formed near to the outlet 31 side of the steering nozzle 30.

In FIG. 7(*b*), upper and lower cores 63 and 64 are set in the upper mold (movable mold) 51 and the lower mold (fixed mold) 52, respectively, of a mold 60.

In the upper and lower cores 63 and 64, recesses 63*a* and 64*a* for forming the upper and lower bosses 28 and 28 (refer to FIG. 3) are formed so as to be apart from the outlet 31 side of the steering nozzle 30 shown in FIG. 3 by some distance, that is, in positions of a distance L2.

The mold 60 is clamped in this state and, after that, by filling a cavity 65 with molten metal, the cylindrical body having a circular truncated cone shape of the steering nozzle 30 is formed by the upper and lower molds 51 and 52 and cores (not shown) in the jet nozzle 24, and the upper and lower bosses 28 and 28 are formed by the upper and lower cores 63 and 64.

In such a manner, the upper and lower bosses 28 and 28 can be formed apart from the outlet 31 side of the steering nozzle 30 by some distance.

As shown in FIGS. 7(*a*) and 7(*b*), by a simple work of replacing the upper and lower cores 53, 54, 63, and 64 at the time of casting the steering nozzle 30, a mold of one kind can be made adapted to various models. Thus, the equipment cost of the mold for casting the steering nozzle 30 can be suppressed.

A second embodiment will now be described. In the second embodiment, the same components as those of the first embodiment are described by the same reference numerals and their description will not be repeated.

Figure 8:
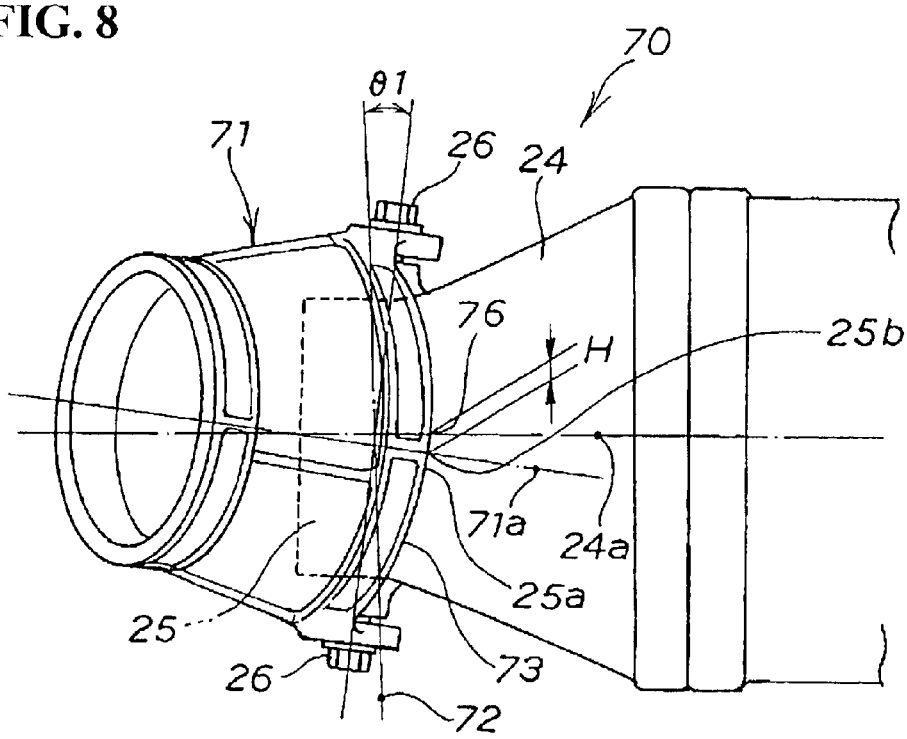
FIG. 8 is a side view showing the main portion of a jet propulsion boat according to a second embodiment of the present invention.

FIG. 8 is a side view showing the main portion of a jet propulsion boat according to a second embodiment the present invention. For easier understanding, a description will be made while omitting the arm 35, joint 37, operational cable 42, and the like shown in FIG. 3.

In a jet propulsion boat 70, in a manner similar to the jet propulsion boat 10 (shown in FIG. 2) of the first embodiment, a steering nozzle 71 is disposed so as to be inclined upwardly towards the rear with respect to the axis of the jet nozzle 24 to efficiently obtain a propulsion force.

To incline the steering nozzle 71 upwardly toward the rear, the upper and lower supporting bolts 26 and 26 for attaching the steering nozzle 71 to the jet nozzle 24 are inclined only by an inclination angle θ1 from a vertical line 72.

At the time of swinging the steering nozzle 71 to the right only by a steering angle θ3 as shown in the diagram, the right end portion 25*b* of the steering nozzle 71 descends only by a distance H on the inlet 73 side of the steering nozzle 71 from the axis 24*a* of the jet nozzle 24. That is, a position 76 in the steering nozzle 71, which is higher than the axis 71*a* only by the distance H comes into contact with the jet nozzle 24.

It is therefore preferable to set the width between parts 75 and 76 (the parts 75 and 76 being symmetric with respect to an axis 75*a*) each of which is higher than the axis 71*a* only by the distance H on the inlet 73 side of the steering nozzle 71 to the maximum width. An example of this configuration will be described by referring to FIG. 9.

Figure 9:
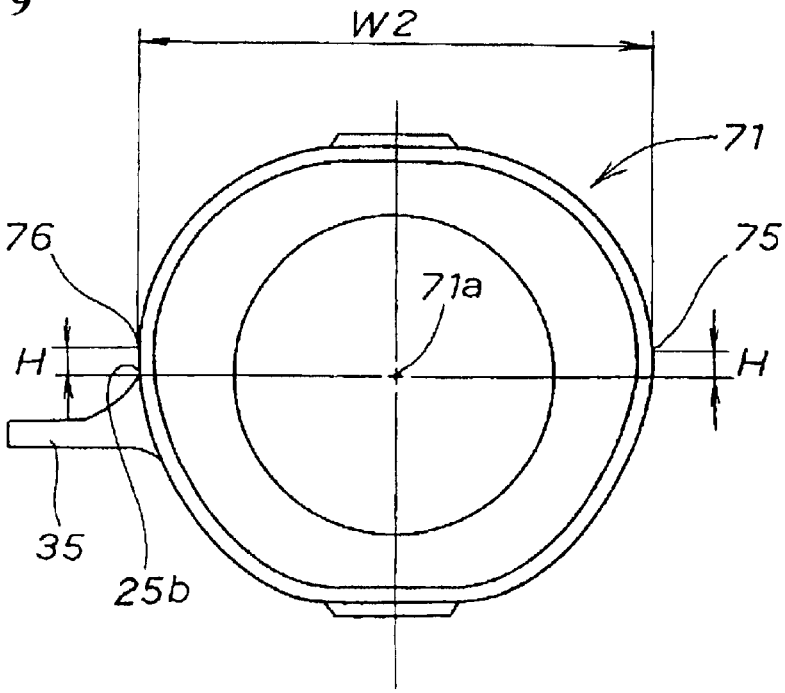
FIG. 9 is a front view showing a steering nozzle of the jet propulsion boat according to a second embodiment of the present invention.
Figure 10:
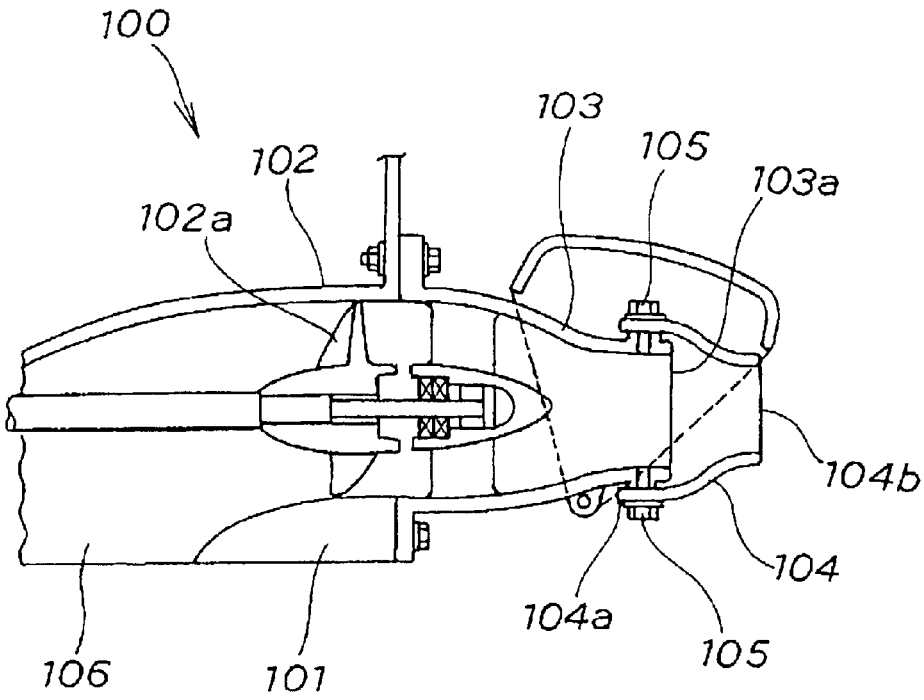
FIG. 10 PRIOR ART
FIG. 10 is a cross section of a conventional jet propulsion boat.

FIG. 9 is a front view showing a steering nozzle of a jet propulsion boat (second embodiment) according to the invention.

The parts 75 and 76 of the steering nozzle 71, each of which is higher than the axis 71*a* only by the distance H come into contact with the outer circumference 25*a* (refer to FIG. 8) of the outlet 25 of the jet nozzle 24. Consequently, in the second embodiment, the steering nozzle 71 is constructed so that the width between the parts 75 and 76 higher than the axis 71*a* only by the distance H is increased to the maximum width W2.

With the configuration, the steering angle from side to side of the steering nozzle 71 can be assured to be larger, and the turning performance of the jet propulsion boat 70 can be assured more excellently.

In the first embodiment, the example in which the upper and lower ends of the inlet 32 side of the steering nozzle 30 are made flat, that is, the inlet 32 side is formed in a flat oval has been described. The shape of the inlet 32 side of the steering nozzle 30 is not limited to the above but can be formed in, for example, in an oval shape.

With the configuration, the present invention produces the following effects.

By setting the vertical diameter of the inlet of the steering nozzle to be smaller than the transverse diameter, the steering nozzle can be disposed closer to the boat bottom. The jet propulsion apparatus can be accordingly disposed closer to the boat bottom, the curvature of the intake path extending from the intake port to the jet propulsion apparatus can be flattened, and the intake path can be formed in a gentle curve.

Consequently, water taken from the intake port can be smoothly directed to the jet propulsion apparatus, so that, for example, the occurrence of a cavitation can be prevented. Therefore, since water can be jetted efficiently, the jet propulsion boat can be favorably propelled.

In addition, by setting the vertical diameter to be smaller than the transverse diameter, the transverse diameter can be assured to be large. Consequently, the steering angle of the steering nozzle can be assured to a specified amount and the steering performance of the jet propulsion boat can be assured sufficiently.

Further, the outlet of the jet nozzle is covered with the inlet of the steering nozzle. With this configuration, even when the vertical diameter of the inlet of the steering nozzle is set to be smaller than the transverse diameter, the portion can be disconnected from the water stream at the outlet of the jet nozzle.

Therefore, exertion of an adverse influence onto the stream of water in the nozzle can be prevented and the jet propulsion boat can be favorably propelled.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A jet propulsion boat comprising:

a jet propulsion apparatus driven by an engine at the stern;

a jet nozzle for jetting water provided to the rear portion of the jet propulsion apparatus;

a steering nozzle swingably supported on the jet nozzle for adjusting the direction of a stream of water jetted from the jet nozzle;

an outlet of said jet nozzle is covered with an inlet of said steering nozzle; and a vertical diameter of the inlet of said steering nozzle is set to be smaller relative to a transverse diameter of the inlet of the steering nozzle;

wherein said steering nozzle includes a maximum wide that is offset upwardly relative to a centerline passing through the transverse diameter of said steering nozzle for assuring an enlarged steering angle.

2. The jet propulsion boat according to claim 1, wherein the steering nozzle is mounted to be inclined upwardly and to the rear with respect to an axis of the jet nozzle.

3. The jet propulsion boat according to claim 2, wherein mounting supports are provided for securing the steering nozzle relative to the jet nozzle with a predetermined angle of inclination being formed therebetween.

4. The jet propulsion boat according to claim 1, wherein said steering nozzle has a circular truncated cone shape wherein the diameter is gradually reduced towards the rear of the jet propulsion boat with flat portions being formed on upper and lower portions on the inlet side.

5. The jet propulsion boat according to claim 4, wherein said flat portion formed on the upper portion of the inlet side of the steering nozzle extends a predetermined distance and the flat portion formed on the lower portion of the inlet side of the steering nozzle extends a predetermined distance for forming the vertical diameter of the inlet of the steering nozzle to be smaller relative to the transverse diameter of the inlet of the steering nozzle.

6. The jet propulsion boat according to claim 5, wherein said jet propulsion boat includes a bottom and said flat portion formed on the lower portion of the inlet side of the steering nozzle enables said steering nozzle to be disposed in close proximity to the bottom of said jet propulsion boat.

7. The jet propulsion boat according to claim 1, wherein on lateral sides of the jet nozzle a first spacing is provided between an outer surface of said jet nozzle and an inner surface of said steering nozzle that is enlarged relative to a second spacing formed on the vertical diameter between an outer surface of said jet nozzle and an inner surface of said steering nozzle for assuring an enlarged steering angle.

8. A steering nozzle for use on a jet propulsion boat comprising:

a jet nozzle for jetting water therefrom;

a steering nozzle swingably supported on the jet nozzle for adjusting the direction of a stream of water jetted from the jet nozzle;

an outlet of said jet nozzle is covered with an inlet of said steering nozzle; and a vertical diameter of the inlet of said steering nozzle is set to be smaller relative to a transverse diameter of the inlet of the steering nozzle;

wherein said steering nozzle includes a maximum wide that is offset upwardly relative to a centerline passing through the transverse diameter of said steering nozzle for assuring an enlarged steering angle.

9. The steering nozzle for use on a jet propulsion boat according to claim 8, wherein the steering nozzle is mounted to be inclined upwardly and to the rear with respect to an axis of the jet nozzle.

10. The steering nozzle for use on a jet propulsion boat according to claim 9, wherein mounting supports are provided for securing the steering nozzle relative to the jet nozzle with a predetermined angle of inclination being formed therebetween.

11. The steering nozzle for use on a jet propulsion boat according to claim 8, wherein said steering nozzle has a circular truncated cone shape wherein the diameter is gradually reduced towards the rear of the jet propulsion boat with flat portions being formed on upper and lower portions on the inlet side.

12. The steering nozzle for use on a jet propulsion boat according to claim 11, wherein said flat portion formed on the upper portion of the inlet side of the steering nozzle extends a predetermined distance and the flat portion formed on the lower portion of the inlet side of the steering nozzle extends a predetermined distance for forming the vertical diameter of the inlet of the steering nozzle to be smaller relative to the transverse diameter of the inlet of the steering nozzle.

13. The steering nozzle for use on a jet propulsion boat according to claim 12, wherein said jet propulsion boat includes a bottom and said flat portion formed on the lower portion of the inlet side of the steering nozzle enables said steering nozzle to be disposed in close proximity to the bottom of a jet propulsion boat.

14. The steering nozzle for use on a jet propulsion boat according to claim 8, wherein on lateral sides of the jet nozzle a first spacing is provided between an outer surface of said jet nozzle and an inner surface of said steering nozzle that is enlarged relative to a second spacing formed on the vertical diameter between an outer surface of said jet nozzle and an inner surface of said steering nozzle for assuring an enlarged steering angle.

* * * * *